US005904421A

United States Patent [19]

Mazzalveri

[11] Patent Number: 5,904,421

[45] **Date of Patent: *May 18, 1999**

[54] DEVICE FOR MIXING PAINTS, VARNISHES AND LIQUID PRODUCTS IN GENERAL AND A METHOD OF CONTROLLING THE DEVICE

[75] Inventor: Leopoldo Mazzalveri, Urbino, Italy

[73] Assignee: Corob S.r.l., Modena, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,370

[22] Filed: Feb. 6, 1997

Related U.S. Application Data

[63] Continuation of application No. 08/429,697, Apr. 27, 1995, abandoned.

[30] Foreign Application Priority Data

May 6, 1994 [IT] Italy ..... B09A00193

[51] Int. Cl.[6] ..... B01F 11/00

[52] U.S. Cl. ..... 366/213; 366/209

[58] Field of Search ..... 366/110, 111, 366/114, 116, 208, 209, 210, 211, 212, 213, 214, 216, 219, 605

[56] References Cited

U.S. PATENT DOCUMENTS

| | | | |
|---|---|---|---|
| 2,022,527 | 11/1935 | Schletz . | |
| 3,706,443 | 12/1972 | Oberhauser . | |
| 3,880,408 | 4/1975 | Karjalainen . | |
| 3,943,844 | 3/1976 | Standbridge et al. . | |
| 4,004,784 | 1/1977 | Distler . | |
| 4,134,689 | 1/1979 | Ahrenskou-Sorensen | 366/605 |
| 4,235,553 | 11/1980 | Gall . | |
| 4,445,782 | 5/1984 | Sparrow, Jr. . | |
| 4,497,581 | 2/1985 | Miller . | |
| 4,568,194 | 2/1986 | Gargioni | 366/605 |
| 4,588,302 | 5/1986 | Pizzi et al. . | |
| 4,789,245 | 12/1988 | Morbeck . | |

(List continued on next page.)

FOREIGN PATENT DOCUMENTS

| | | |
|---|---|---|
| A-093091 | 11/1983 | European Pat. Off. . |
| A-0317112 | 5/1989 | European Pat. Off. . |
| A-0587085 | 3/1994 | European Pat. Off. . |
| A-0617998 | 10/1994 | European Pat. Off. . |
| A-0631810 | 1/1995 | European Pat. Off. . |
| 1080072 | 4/1960 | Germany . |
| 2819833 | 11/1978 | Germany . |
| 2725080 | 12/1978 | Germany . |
| 2809513 | 9/1979 | Germany . |
| 92 06 841 U | 8/1992 | Germany . |
| 93 07 761 U | 8/1993 | Germany . |
| 93 20 352 U | 6/1994 | Germany . |
| A-1310655 | 3/1973 | United Kingdom . |
| A-2192138 | 1/1988 | United Kingdom . |
| WO-A 91 08045 | 6/1991 | WIPO . |

*Primary Examiner*—Randall E. Chin

*Attorney, Agent, or Firm*—Sughrue, Mion, Zinn, Macpeak & Seas, PLLC

[57] ABSTRACT

A device for mixing paints, varnishes and liquid products in general comprises a support unit for the liquid products, which is intended to support and clamp at least one container. A series of sensors is associated with the device in order to provide signals indicative of a characteristic of the container or of the liquid products, for example, the size of the container. Further sensors provide signals indicative of the position of the support unit during its mixing movement. Further signals coming from units outside the device, together with any data input by an operator, contribute to the selection and the control of the sequence or mode of operation in a mixing method including the steps of starting, regulating and stopping a main motor and an auxiliary motor for clamping and releasing the container and for locking the support unit in a predetermined starting position which corresponds to a final position upon completion of the mixing.

19 Claims, 6 Drawing Sheets

U.S. PATENT DOCUMENTS

| | | | |
|---|---|---|---|
| 4,834,548 | 5/1989 | Tempel et al. . | |
| 4,842,415 | 6/1989 | Cane | 366/605 |
| 4,966,467 | 10/1990 | Johnson | 366/209 |
| 5,035,601 | 7/1991 | Lin . | |
| 5,066,136 | 11/1991 | Johnson | 366/209 |
| 5,121,991 | 6/1992 | Wakatake . | |
| 5,197,802 | 3/1993 | Miller et al. . | |
| 5,261,744 | 11/1993 | Brunn . | |
| 5,268,620 | 12/1993 | Hellenberg | 366/605 |

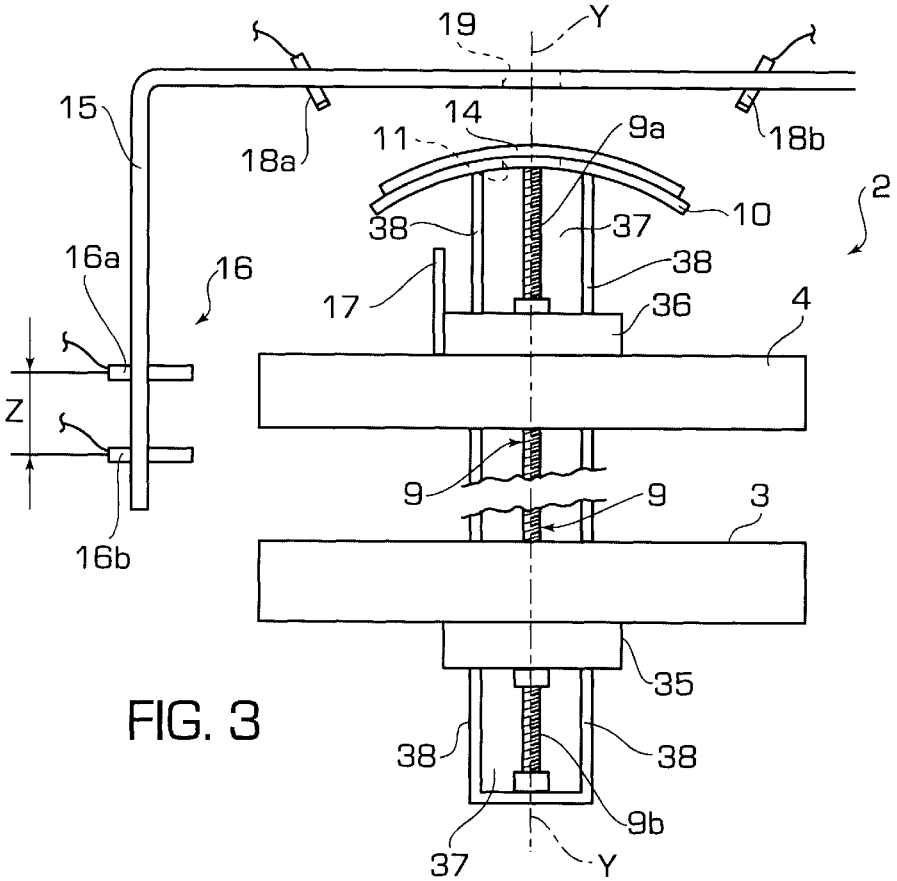
FIG. 3
FIG. 4
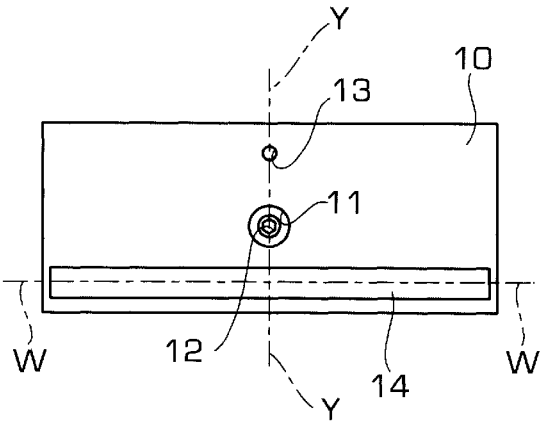
FIG. 5
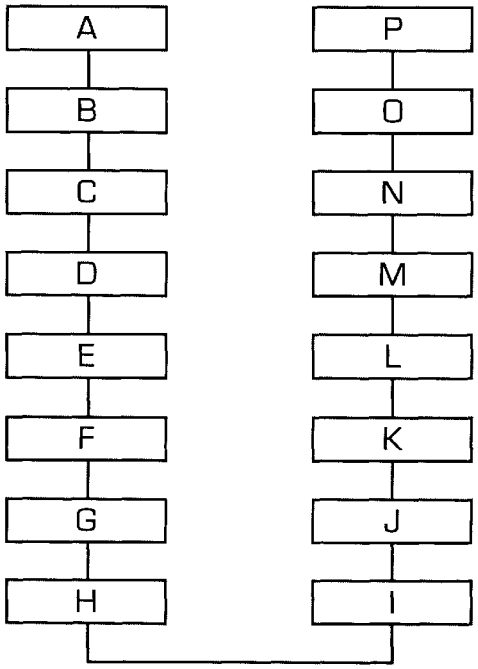

DEVICE FOR MIXING PAINTS, VARNISHES AND LIQUID PRODUCTS IN GENERAL AND A METHOD OF CONTROLLING THE DEVICE

This is a continuation of application No. 08/429,697 filed on Apr. 27, 1995, now abandoned.

BACKGROUND OF THE INVENTION

The subject of the present invention is a device for mixing paints, varnishes and liquid products in general.

A further subject of the present invention is a method of controlling a device of the type indicated above.

The invention has been developed particularly, but not exclusively, for a mixing device of the type with gyroscopic action in which a support unit for at least one container for liquid products is rotated simultaneously about two perpendicular axes. For simplicity, the following description will refer to a single container, without thereby excluding the possibility of the principles of the invention being applied to the agitation of several containers simultaneously.

In known mixing devices, a generally cylindrical container containing the liquid or liquids to be mixed or homogenized is supported and clamped in an upright position by the support unit in a configuration thereof which will be referred to below as the starting configuration. The energizing of a main electric motor operatively connected to the support unit causes it to move gyroscopically at a predetermined speed of rotation for a predetermined period of time. After the motor has been de-energized, the motion of the support unit slows down until it stops in a final configuration which generally differs from the starting configuration in which the container is in an upright position. It is therefore the task of the operator to act manually on the support unit to return it to the starting configuration so that the container can be released and removed in an upright position.

SUMMARY OF THE INVENTION

A disadvantage of known mixing devices and of the methods of controlling them consists of the fact that it is necessary to provide a plurality of control and safety systems which may even be redundant, to prevent the operator from being able to act manually on the support unit when it is still in motion or in a potentially dangerous condition owing to the possibility, for example, of the main electric motor being switched on accidentally.

Another disadvantage of known mixing devices and the methods of controlling them is that, because the gyroscopic motion is activated immediately, significant stresses are transmitted to the structure of the mixing device as a whole owing to the inertial forces developed due to the movable masses of the mixing device and, in particular, to the masses of the bulky and heavy containers which are subject to the gyroscopic effect.

Moreover, the manner in which known mixing devices operate and, in particular, the instantaneous activation of the motion at an operating speed, make it difficult to achieve correct and uniform distribution of the liquid products inside the container, so that it is usually necessary to lengthen the time and/or increase the speeds of rotation to achieve satisfactory mixing results.

A further disadvantage of known devices and methods is that the selection and setting of certain times and speeds of rotation are generally not very versatile and do not enable the mixing device to adapt quickly and adequately to different quantities or qualities of the liquid products, to different standard dimensions of the containers, or to particular or contingent requirements of the individual user or operator.

The object of the present invention is to overcome the disadvantages of the prior art by providing a flexible method with improved safety for the operator, which achieves good mixing efficiency and, at the same time, is simple and cheap to apply.

A second object of the present invention is to provide a mixing device of the type indicated above, which is easy and cheap to produce and which solves the problems of the prior art.

An advantage of the present invention consists of the fact that the manual operation, by an operator, of the mechanical members of the mixing device and of the various components of a control device in general, such as, for example, a control panel, is reduced to the minimum absolutely necessary. In particular, this manual operation is limited simply to the positioning of the container on the support unit and to its subsequent removal upon completion of the mixing operation.

Moreover, a device and a method according to the present invention achieve a better mixing result than that achieved according to the prior art or, for the same quality, the mixing times are considerably reduced without the need to increase the speed of rotation, with a consequent saving in terms of the operating cost, the cost of the main electric motor and the wear of the mechanical members of the mixing device.

BRIEF DESCRIPTION OF THE DRAWINGS

Further characteristics and advantages of the present invention will become clear from the following description of a preferred embodiment given purely by way of non-limiting example, with reference to the appended drawings, in which:

FIG. 3 is a schematic front view of a unit for supporting a container, FIG. 4 is a schematic view, taken on the arrow IV of FIG. 3, of a detail of the support unit of FIG. 3 seen from above, FIG. 5 is a chart of the sequence of steps of the control method according to the present invention.

DETAILED DESCRIPTION OF THE INVENTION

Figure 1:
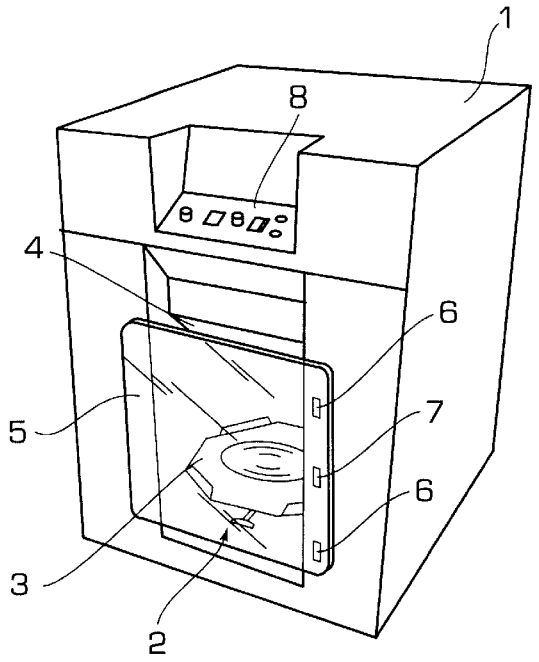
FIG. 1 is a perspective view of a gyroscopic mixing device.

With reference now to FIG. 1, a gyroscopic mixing device comprises an outer casing 1 with a load-bearing or simply protective and covering function, which houses a main motor, preferably an electric motor (not shown), the output driving shaft of which is operatively connected, in known manner, for example by means of a belt and pulley transmission, possibly with the interposition of a reduction unit, to a support unit 2 including two opposed and facing rotatable plates 3, 4. The connection between the main motor and the support unit 2 is such that a rotation of the driving shaft brings about a corresponding rotation of the support unit 2, but generally of a different magnitude, about a first horizontal axis and a simultaneous rotation of at least one of the two plates 3, 4 about a second axis perpendicular to the first axis and to the faces of the plates 3, 4 and preferably extending through their centers of gravity.

The support unit, and consequently at least one of the two plates 3, 4, can be rotated selectively in opposite senses of rotation with the use of known means such as, for example, a mechanical reversing unit included in the reduction unit, or by means of an electric motor having a selectable sense of rotation.

The front portion of the casing 1 has an opening for access to the interior of the mixing device and, in particular, to the support unit 2 or at least to the lower plate 3. Alternatively, the opening may allow the lower plate 3 to be removed so that a container containing the liquid to be mixed can be loaded manually or automatically thereon.

A door 5 for closing the access opening has sensors 6, for example, micro-switches or the like, which provide signals indicative of the open or closed position of the door. The mixing device also has an automatic locking element 7 operated, for example, electromagnetically, for selectively locking the door 5 when it is in the closed position. A control and indicator panel 8 is also mounted on the front of the casing.

With reference now to FIG. 3, the two plates 3, 4 of the support unit 2 are mounted for rotating on respective support brackets 35, 36 which in turn are mounted slidingly on and projecting from an upright 37, by means of sliding guides 38.

At least one of the two plates 3, 4, preferably the upper plate 4, is operatively connected to the upright 37 in a manner such that a rotation of the upright about the first, horizontal axis of rotation, perpendicular to the plane of the paper in FIG. 3 takes place during a rotation of the plate relative to the corresponding support bracket. This operative connection can be achieved by one of the systems known in the art and, since it does not fall within the scope of the present invention, is not shown in the drawings and will not be discussed further in the present description.

An operating screw 9 extending substantially along the entire length of the upright 37 is rotatable and fixed longitudinally relative thereto. The screw 9 comprises two threaded portions, an upper portion 9*a* and a lower portion 9*b*, one having a right-hand thread and the other a left-hand thread. The two threaded portions 9*a*, 9*b* engage helically in respective threaded holes in the support brackets 35, 36, so that a rotation of the screw 9 brings about a simultaneous movement of the plates 3, 4 in opposite directions, apart or towards one another, according to the sense of rotation of the screw 9.

A curved plate 10 fixed to the upper end of the upright 37 has a first access hole 11 (see also FIG. 4) through which the upper end of the screw 9, which has an axial hexagonal operating recess 12, is accessible from above. The plate 10 is disposed symmetrically with respect to a longitudinal plane which extends through the axis of the screw 9, and the line of which in the plane of FIGS. 3 and 4 is indicated Y—Y. The axis of curvature of the plate 10 coincides substantially with the first, horizontal axis of gyroscopic rotation. The axes of the access hole 11 and of a second, locating hole 13 also extending through the curved plate 10, lie in the median plane Y—Y of the plate.

In a preferred embodiment, the support unit 2 is at least partially isolated from the rest of the equipment included in the mixing device by means of a protective structure 15, for example, a box-like structure so that any leakages or spillages of liquid during the mixing operation do not damage the rest of the device. One or more holes 19 formed in the upper part of the protective structure 15 afford access to the holes 11, 13 in the curved plate 10 from above.

Art elongate strip 14 of reflective material constituting one of the two elements of a photoelectric-cell detection unit is applied to the upper surface of the curved plate 10 on the opposite side to the screw 9, in a front region thereof. The elongate strip 14 follows the curved shape of the plate 10 and is also disposed symmetrically with respect to the plane Y—Y.

Inside the mixing device, are sensor units, preferably of the type with photoelectric cells, preferably mounted through the protective structure 15. In particular, the sensor units comprise two photoelectric cell elements 16*a*, 16*b* oriented horizontally towards the support unit 2 and spaced apart vertically by a distance Z. A plaque 17 of reflective material for interacting with the photoelectric cells 16*a*, 16*b*) is mounted on one of the two brackets 35, 36, preferably on the upper bracket 36. In use, each of the two photoelectric cells 16*a*, 16*b* provides a signal indicative of the fact that at least a portion of the plaque 17 is at the same height as the photoelectric cell. For greater clarity and solely for the purpose of describing the preferred embodiment, it will hereinafter conventionally be assumed that each of the two photoelectric cells emits a high logic-state signal, that is, one, when at least a portion of the plaque 17 is at the same height as the photoelectric cell and, otherwise, a low logic-state signal, that is, zero.

Two photoelectric cells 18*a*, 18*b* mounted above the support unit 2 are disposed in a plane which intersects the elongate strip 14 and are angled relative to each other by an angle substantially equal to the angle subtended by the curved elongated strip 14. Thus, the photocells are aligned with the ends of the strip 14.

Figure 2:
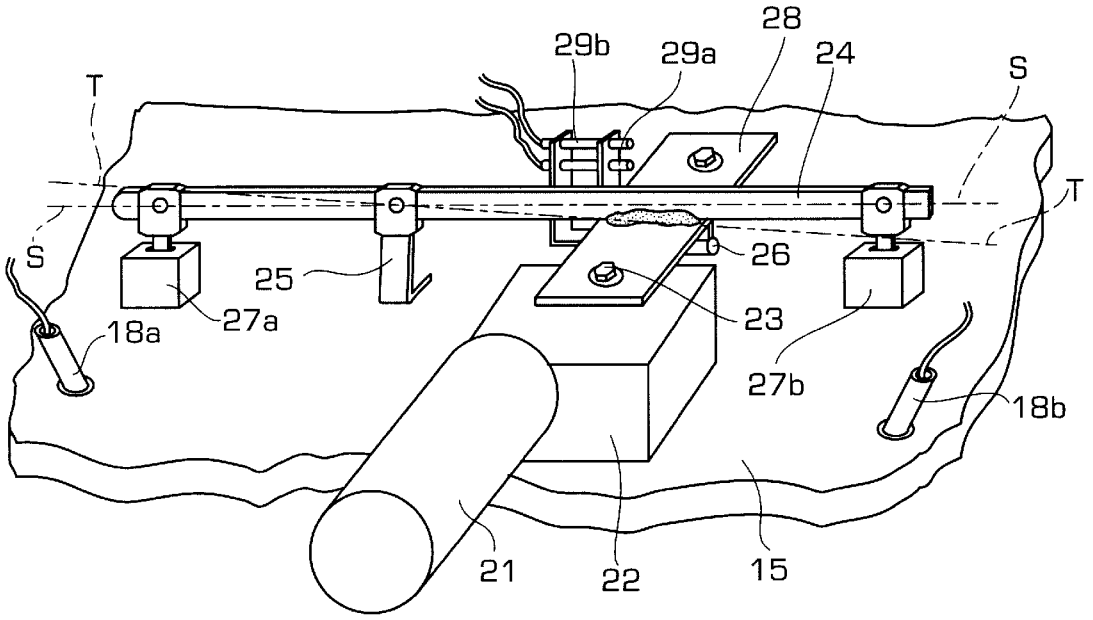
FIG. 2 is a perspective view of a detail of the device of FIG. 1, on an enlarged scale.

FIG. 2 shows an operating unit disposed outside the protective structure 15 in a region above the support unit 2 for bringing about the movement of the plates 3, 4. The operating unit comprises an auxiliary electric motor 21 operatively connected, by means of a reduction unit 22, to an operating member 23 which, since its lower end is formed like a hexagonal bar and extends through the structure 15 through one of the holes 19 (see FIG. 3), can selectively engage the hexagonal cavity 12 of the screw 9, as described further below.

The upper end of the operating member 23 is rotatable on a support appendage 28 of a pivoting arm 24. The coupling between the reduction unit 22 and the operating member 23 enables the latter to slide vertically and is formed according to known techniques, for example, by means of a coupling with a splined profile. A locating pin 26, also fixed to the support appendage 28, is aligned with the hole 13 in the curved plate 10 and can selectively engage it through the hole 19 when the plate 10 is in the position shown in FIG. 3.

The pivoting arm 24 is mounted for pivoting at an intermediate position thereof on a fulcrum support 25 fixed to the structure 15. The ends of the pivoting arm are articulated to two electromagnet units 27*a*, 27*b* which are energized alternately and pivot the arm 24 to and fro between a position in which its longitudinal axis is in the position indicated by the line S—S in FIG. 2 and a position in which the axis reaches the position indicated by the line T—T. The length of the arm 24, the position of the fulcrum 25, and the position of the operating member 23 and of the pin 26 relative thereto are such as to render the rotation effect negligible in comparison with the vertical translation effect during the movement of the axis of the arm 24 from the position S—S to the position T—T.

In a preferred embodiment, the appendage 28 is constituted, essentially, by a horizontal plate, the position of which relative to the two positions S—S and T—T of the arm 24 is detected by two sensors 29*a*, 29*b*, preferably, but not necessarily, constituted by proximity sensors.

In the position shown in FIG. 2 and indicated by the line S—S, which will be referred to below as the release position, the operating member 23 and the pin 26 are raised and do not prevent the rotation of the support unit 2, whereas in the position indicated by the line T—T, and called the engagement position below, the operating member 23 and the pin 26 are in the lowered position and engage the hexagonal recess 12 in the screw 9 and the locating hole 13, respectively, when the support unit 2 is in the starting configuration of FIG. 3. The locating pin preferably projects downwardly to a greater extent than the operating member 23 so that if, owing to a slight deviation of the support unit 2 from the starting configuration, the locating pin does not succeed in engaging the hole 13 and presses against any portion of the curved plate 10, the operating member remains spaced apart from the plate 10 go as not to be damaged thereby.

The method of controlling a mixing operation will now be described with reference to the chart of FIG. 5; after a container of liquid to be mixed has been positioned manually or automatically on the lower plate 3 of the mixing device, the mixing is started, in a step indicated A, for example, by the pressing of a starter button disposed on the control panel 8, by an operator.

In a subsequent step B, the state of the sensors 6 is examined to check that the door 5 is closed. If this condition is not confirmed, an error condition is generated involving, for example, an alarm signal on the panel 8 and the interruption of the process. If, however, the door 5 is correctly closed, consent is given for the activation of the locking device 7 which prevents any subsequent opening of the door 5, even accidentally.

During a subsequent step C, the auxiliary electric motor 21 is started with a sense of rotation such as to move the plates 3, 4 towards one another so as to grip the container on the support unit 2.

A step D involves the detection of the characteristics of the container gripped on the support unit 2, for example, the measurement of its height given by the distance between the plates 3, 4. This detection can be carried out by means of sensors of various types such as, for example, photoelectric cells, micro-switches, sliding electrical contacts, or encoders coupled to the screw 9, in order to detect discrete or continuous values of the distance between the two plates. In addition or alternatively, sensor means, for example, such as piezoelectric or extensometric sensors, or the like, may be provided for detecting the weight of the container disposed on the lower plate, or its bulk, or other characteristics of interest.

Figure 7:
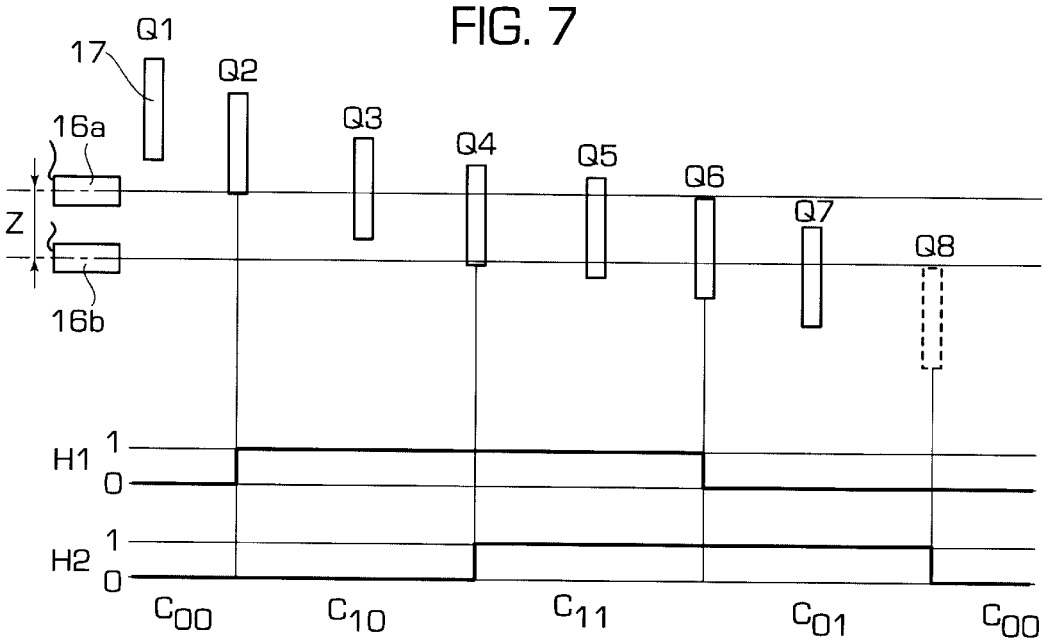
FIG. 7 is a diagram showing, by way of example, a possible way of implementing the regulation shown in FIG. 6, and FIGS. 8, 9 and 10 show schematically a flow chart for a specific preferred application of the method of FIG. 5.

In the preferred embodiment shown in the drawings, the detection takes place by the detection of the vertical position of the reflective plaque 17 fixed to the bracket 36 supporting the upper plate 4 by means of the photoelectric cells 16*a*, 16*b*. FIG. 7 is a diagram showing the operating principle. In a position indicated Q1, the upper plate 4 is fully raised and the plaque 17 is not detected by the photoelectric cells 16*a*, 16*b*. The signals H1 and H2 supplied by the photoelectric cells therefore assume the same zero-level logic value identifying a state $C_{00}$. This state can be displayed on the control panel 8, for example, by means of a digital display, an indicator lamp, or other similar means, or may constitute an input datum for an electronic processing system.

At the moment when the plates 3, 4 move towards one another to reach the position Q2, the upper photoelectric cell 16*a* detects the lower end of the plaque 17 and the signal H1 changes to the high level of one. The combination of the signal H1 which is high and the signal H2 which is low identify a state $C_{10}$ which persists during the movement of the plates towards one another through positions of which Q3 is an example. If the height of the plaque 17 is greater than the vertical distance Z between the two photoelectric cells 16*a*, 16*b*, in the position Q4 in which the lower end of the plaque 17 is detected by the lower photoelectric cell 16*b* and the signal H2 (changes to level one, the upper photoelectric cell 16*a* continues to detect the presence of the plate and the signal H1 remains at level one. This combination of signals identifies a state $C_{11}$ which also persists in the position Q5 until, in the position Q6, as a result of further movement of the plates 3, 4 towards one another, in the position Q7, the tipper end of the plaque 17 is no longer detected by the upper photoelectric cell 16*a*. The signal H1 assumes the zero level and, with the signal H2 which is still high, identifies a state $C_{01}$. If the plates are moved further towards one another, passing through the position Q7 until they reach the position Q8 shown in broken outline in the drawing, the plaque 17 moves completely outside the field of detection of both of the photoelectric cells, which results in a return to a state $C_{00}$ in which both of the signals H1 and H2 have values of zero.

Figure 6:
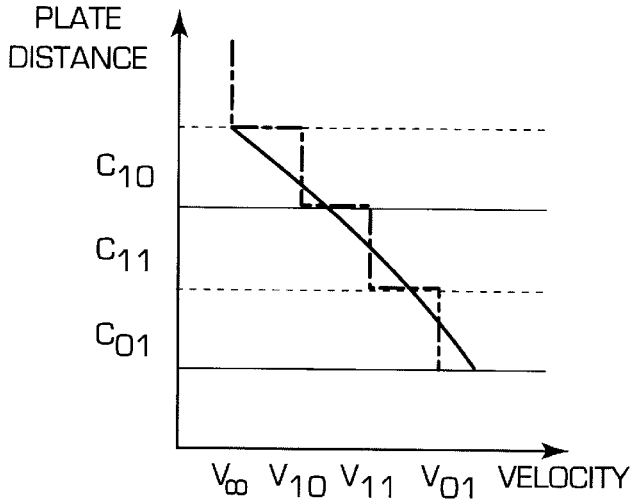
FIG. 6 is a graph indicating the regulation of the speed of a mixing device according to the present invention.

In a first embodiment, in order to adjust one or more of the operating parameters of the mixing device, particularly, but not exclusively, the speed of rotation of the support unit 2, active use is made solely of the states $C_{10}$, $C_{11}$ and $C_{01}$ which, as is shown in the graph of FIG. 6, may lead to the manual or automatic selection of three different operating speeds $V_{10}$, $V_{11}$ and $V_{01}$ which increase progressively with decreases in the spacing of the plates, and hence the dimensions of the container. The state $C_{00}$ gives rise to an error condition whether it is brought about by the plaque 17 being in the position Q1 or in the position Q8.

In another embodiment, the positions of the plaque 17 and of the photoelectric cells 16*a*, 16*b* are selected in a manner such that the movement of the plates as close together as possible or the reaching of a travel limit, for example, a mechanical limit, never results in the reaching of the position Q8 shown in broken outline in FIG. 7 and, therefore, in the activation of the state $C_{00}$, on the right-hand side. The state $C_{00}$ on the left-hand side can therefore also be used to regulate the speed by the association of this state with an operating speed $V_{00}$. Naturally, in this case, it is preferable to provide other systems and devices for indicating incorrect positioning of the plates 3, 4. Similarly, the plaque 17 may be prevented from being in the position Q1 in order to make use of the state $C_{00}$ brought about in the position Q8 on the right-hand side in FIG. 7 to regulate the mixing device, particularly its speed.

Sensors may be provided for detecting various characteristics of the container and the liquid product therein. Examples of the quantifiable characteristics are the height of the container, the volume of the container, the weight of the container, the volume of the liquid products, the weight of the liquid products, the density of the liquid products, the viscosity of the liquid products and the composition of the liquid products.

In any case, and regardless of the method of detecting the characteristics of the container and the liquids to be mixed, one or more detections of the characteristics of the container can in any case be associated with a program for the variation of the operating parameters of the mixing device such as, for example: the total mixing time, any pauses in the mixing cycle, acceleration/deceleration gradients or operating speeds of rotation such as that indicated by a continuous line in FIG. 6.

The mixing device may be driven in a sequence of operation selected from at least first and second different sequences of operation in dependence on at least one signal indicative of at least one quantifiable characteristic of the liquid products or of the container. The first and second sequences of operation may differ, within a period of time not exceeding the duration of the complete mixing cycle, for at least one of the following parameters:

the period for which the drive means are activated, the speed of the motion imparted to the support unit, the acceleration imparted to the liquid products, the configuration of the motion of the support unit, and the amplitude of the motion of the support unit.

With further reference to the method shown in FIG. 5, in a step E, according to the values detected in the step D, operating parameters of the mixing cycle derived, for example, from predefined reference tables preferably stored in numerical or digital form for use with electronic processing devices, are set. FIG. 6 relates to two examples of the relationship between the distance between the plates 3, 4 in the condition in which the container is clamped and the variation of the operating speed of rotation, with continuous progression (shown by a continuous line) or stepped progression (shown in chain line). The graph of FIG. 6 also shows minimum and maximum threshold values (broken lines) of the distance between the plates beyond which, for example, an error signal is provided for on the panel 8, for example, to warn the operator that the measurement of the container detected exceeds the designed range of use of the mixing device.

The support unit 2 is then released from its starting configuration, shown in FIG. 3, in a step indicated F in FIG. 5. This release step preferably takes place automatically without the need for manual intervention by the operator with a device of the type shown in FIGS. 2 to 4 and described above.

In a step G, consent is given for the rotation of the main electric motor to be started and a subsequent step H provides for an initial rotation at low speed and preferably of limited amplitude to be imparted to the support unit 2 in a first sense, for example, clockwise when looking at the mixing device from the front. In a preferred embodiment, the rotation is less than one complete turn and, preferably, is about 180°, that is, one half-turn. This initial limited rotation is particularly advantageous for the mixing of pigments with bases for paints or varnishes since a distribution of the pigment inside the container such as to ensure a good mixing result even with short mixing times is already achieved at this stage.

In a step I, the sense of rotation of the main electric motor is reversed and it is accelerated progressively, for example, according to a law with a continuous or discontinuous gradient, so as to reduce the loads due to inertial forces, until the operating speed of rotation predefined in step E is reached in a following step J.

At the start of the step J, the count-down of the mixing time is started, until the value of the mixing period predefined in step E is reached in a step K. The step K in which the effective mixing period is completed, is followed by a step L during which the rotation of the support unit 2 is slowed progressively until it reaches a predetermined low value, preferably of a few revolutions per minute. Alternatively, the change from the operating speed of the step K to the slow speed may take place directly without progressive slowing if the difference between the two speeds is not such as to cause significant stresses due to the inertial forces of the rotating masses. Naturally, the selection of the type of regulation of the speed of the electric motor in step L can also be determined in accordance with operating parameters detected in step E.

In a subsequent step M, whilst the support unit 2 is rotating at low speed, the reaching of the angular position of the support unit corresponding to the starting position is detected by means of sensors in the manner described further below and, in a step N, the device for locking the support unit 2 described above is activated, the main electric motor simultaneously being de-energized. In a preferred embodiment, the main electric motor is de-energized when an angular position before the starting configuration of the support unit 2 is reached, the support unit 2 reaching this configuration by virtue of its inertia. In this case, the system for locking the support unit advantageously has a resilient catch system, for example, consisting of a helical spring associated with the locating pin 26 so that the locating pin is brought to bear against the curved plate 10 and engages the hole 13 automatically. Similar systems consisting, for example, of ratchet or cam devices or the like may also be provided.

In a step 0, the auxiliary electric motor is started and moves the plates 3, 4 apart, releasing the container. Upon completion or the method, with the electric motors deactivated and the support unit 2 stationary and locked in the starting configuration, in a last step P, consent is given for the opening of the door 5, by the release of the locking device 7.

Figure 8:
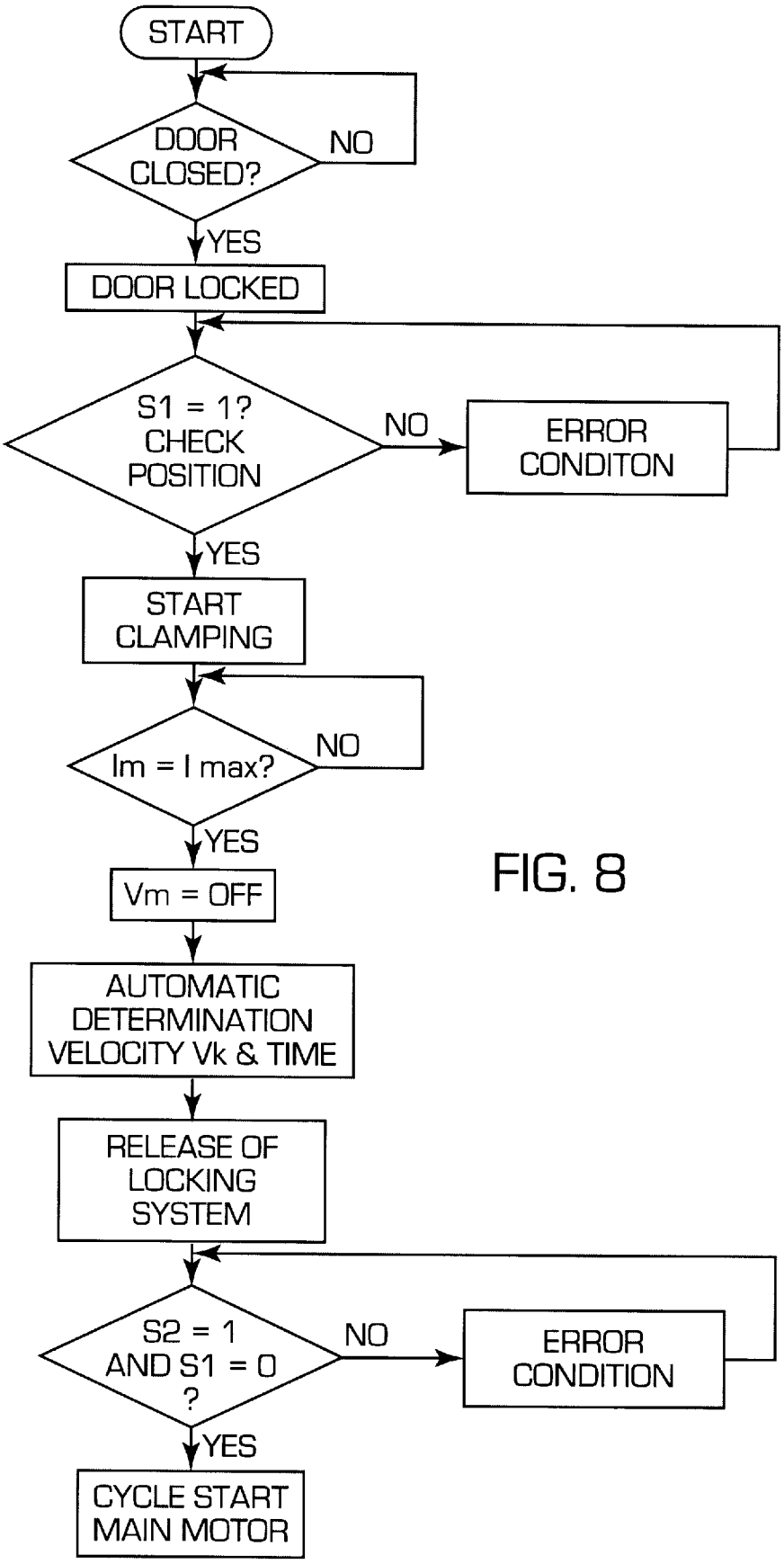
Figure 9:
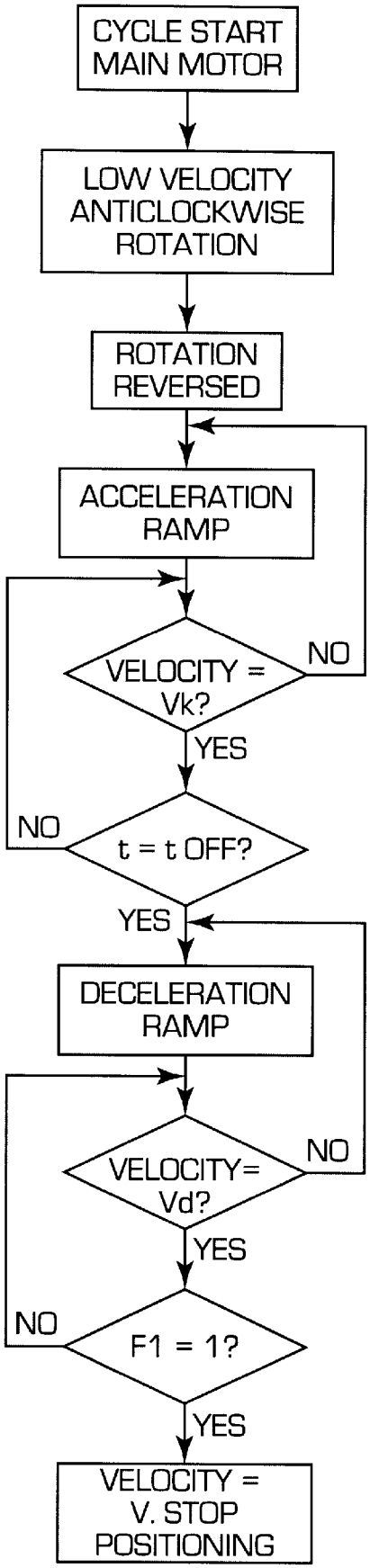
Figure 10:
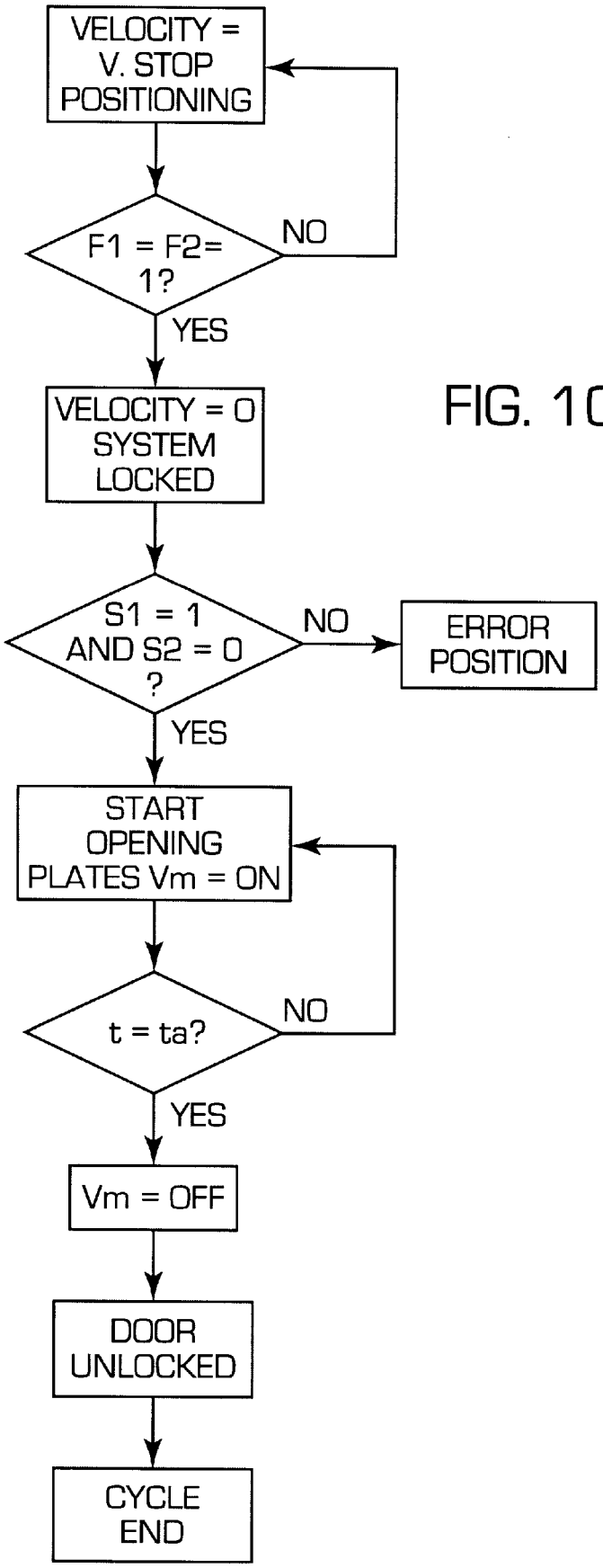

The flow charts of FIGS. 8 to 10 show a specific example of the control of the mixing device during an operating cycle. This specific example is particularly applicable to an electronic system, preferably with a microprocessor, for controlling the mixing method of the present invention. In FIG. 8, the starting of the method (START) brought about, for example, by the pressing of a starter button on the control panel 8, is followed immediately by an assessment of the values of the signals coming from the sensors 6 for detecting the closure of the door 5. If the closed condition is confirmed, the control goes on to the next process box which brings about the locking of the door 5 by providing a signal for activating the locking device 7.

The value of a signal S1 supplied by the sensor 29*a* of FIG. 2 is then evaluated in a decision box. If the value of this signal indicates that the pivoting arm 24 is in the engagement position (T—T) locking the support unit 2, the control goes on to the next box which represents the start of the operation to clamp the plates 3, 4 onto the container, otherwise the method is stopped in a loop, generating an error condition, which in the simplest case, gives rise to a signal, for example, an optical or acoustic signal.

The operation to clamp the plates 3, 4 provides for the starting of the auxiliary motor 21 and constant comparison of the current Im flowing in motor with a predetermined threshold value Imax. When the current Im reaches the threshold value Imax, the control goes on to the next process box which causes the supply to the auxiliary motor 21 to be cut off (Vm=Off) . A unit for the coordination of the operative parameters of the mixing cycle then evaluates the data and the signals coming from the sensors which detect the characteristics of the container and of the liquid to be mixed, integrates them with any particular data input by the operator or coming from external processing units, and sets the operative parameters of the mixing cycle, for example, according to the criteria expressed above with reference to the functional boxes D and E of FIG. 5. The coordination unit may also check the integrity and appropriateness of the data received. In an alternative embodiment, the data relating to the characteristics of the container or of the liquid products come directly and exclusively from an external processing unit.

A process box deals with the release of the locking system of the support unit 2, for example, by providing an activation signal to the unit shown in FIG. 2 which causes de-energizing of the electromagnet 27*b* and simultaneous energizing of the electromagnet 27*a* to bring the pivoting arm to the release position (S—S). The success of this operation is checked in a decision box in which the values of both of the signals S1 and S2 supplied by the sensors 29*a,* 29*b* are evaluated. In particular, it is checked that the signal S1 is zero and that the signal S2 is simultaneously at the high level. It is particularly important that the release of the locking device of the support unit 2 is checked with a certain degree of safety, since the starting of the main motor of the mixing device with the support unit still locked could lead to serious damage or problems.

When the release has taken place and been checked, the actual mixing cycle starts. A process box starts the low-speed rotation of the support unit 2 in a predetermined sense which, in this example, is assumed to be anticlockwise. The mode of operation in this step may either be predetermined by the operator, or be fixed at the design stage, or may be modified from time to time in dependence on the detected parameters of the characteristics of the container. In particular, the operative parameters may comprise the speed of rotation, the acceleration, the rotation time, and the amplitude of the arc of rotation. In a preferred embodiment, the support unit of the container is driven anticlockwise through 180° or one half turn. The speed of rotation may be determined by detecting the frequency of the passage of the strip 14 beneath at least one of the sensors 18*a,* 18*b*. Alternatively, known devices such as tachometric counters, encoders, or the like may be used.

A subsequent process box reverses the sense of rotation of the support unit 2, to clockwise in the example. In this case also, the parameters may be derived by the processing of the previously-detected and analyzed characteristics of the container and of the liquid. A subsequent box controls the way in which the speed is changed from zero at the moment when the motion is reversed to the operating speed Vk, by applying a predefined or calculated law for the variation of the motion, preferably with a continuous upward gradient. A first decision box performs a check that the operating speed Vk has been reached, linked with a check made by a second decision box on the reaching of the total mixing time (t off) carried out by usual counting and checking methods with timers, counters and the like, either by software means or with mechanical or electromechanical devices. When the period for which the mixing device has been activated equals the total time defined (t=t off), a process box regulates the deceleration of the main motor in exactly the same way as was described with reference to its acceleration. A decision box compares the speed of the support unit 2 with a reference speed Vd considerably lower than the operating speed Vk.

When the effective speed of rotation equals the reference speed Vd, a subsequent decision box evaluates the signal F1 supplied by one of the sensors 18*a,* 18*b*), particularly by the photoelectric cell 18*a,* if the support unit 2 is rotating clockwise. When the photoelectric cell 18*a* detects the passage of the first end of the strip 14 on the left-hand side in FIGS. 3 and 4 when the support unit 2 is rotating clockwise, the signal F1 supplied thereby causes the control to go on to the next process block which further reduces the speed of the support unit, in practice, in the preferred embodiment, to a speed "V stop" equal to a few revolutions per minute.

With reference to FIG. 10, whilst the support unit is rotating at the speed "V stop", a decision box constantly checks the signals F1 and F2 supplied by the photoelectric cells 18*a,* 18*b*. When the left-hand and right-hand ends of the strip 14 are detected by the photoelectric cells 18*a,* 18*b,* respectively, and the signals F1 and F2 thus assume the same high logic value, a process box de-energizes the main motor, possibly activates a brake, and activates the locking unit of the support unit 2, in particular, it energizes the electromagnet 27*b* and de-energizes the electromagnet 27*a* so as to bring the arm 24 to the engagement position shown in FIG. 2. The engagement of the support unit 2 is checked by the evaluation of the signals S1 and S2 supplied by the sensors 29*a,* 29*b*.

A subsequent process box energizes the auxiliary motor 21 (Vm=On), whilst a decision box keeps the motor activated until the energizing time reaches a predetermined value so as to ensure that the plates 3, 4 move apart by a predetermined distance depending on the energizing time ta, the speed of the auxiliary motor 21, and the transmission ratio of the transmission members.

The subsequent boxes control the concluding steps of the mixing cycle, that is, the de-energizing of the auxiliary motor 21 (Vm=Off) and the de-activation of the locking device 7 to allow the door 5 to be opened.

Naturally, the principle of the invention remaining the same, the forms of embodiment and details of construction may be varied widely with respect to those described and illustrated, without thereby departing from the scope of the present invention.

In particular, the principle of the invention is not limited to application to a gyroscopic mixing device but may be applied to mixing devices of other types, for example, of the vibration type and the like.

What is claimed is:

1. A device for mixing liquid products comprising:

a support unit for supporting at least one container for the liquid products, driving means including a main motor operatively connected to the support unit in order to impart thereto a motion for mixing the liquid products, and signaling means for providing at least one signal indicative of at least one quantifiable characteristic of said liquid products or of said at least one container;

wherein said device also comprises microprocessor control means for selectively activating the main motor according to at least one sequence of operation selected in dependence on said at least one signal indicative of said at least one quantifiable characteristic of said liquid products or of said at least one container, said at least one sequence of operation including at least one operating parameter wherein said microprocessor control means varies said at least one operating parameter on the basis of said at least one signal, wherein said device comprises a unit for locking the support unit in a predetermined starting configuration.

2. A mixing device according to claim 1, wherein said support unit comprises a pair of opposed clamping plates movable in opposite directions towards and away from one another in order to clamp or release the at least one container, at least one auxiliary motor being provided for operating the clamping plates during the clamping or release of the container.

3. A mixing device according to claim 2, wherein said auxiliary motor is an electric motor, the clamped condition of the container being detected by means for detecting the current flowing in the auxiliary motor and by means for comparing the current flowing with a predetermined maximum current level.

4. A mixing device according to claim 3, wherein said device comprises sensor means associated with at least one of the clamping plates for detecting said at least one quantifiable characteristic in the clamped condition of the container and providing said at least one signal for the selection of the sequence of operation.

5. A mixing device according to claim 4, wherein said sensor means detect the size of the container in a direction parallel to the distance between the plates.

6. A mixing device according to claim 1 wherein said device is gyroscopic, the support unit being rotatable about a principal axis, and angular reference means being associated with the support unit for determining its angular position.

7. A mixing device according to claim 6, wherein said unit for locking the support unit comprises an arm which pivots from a first, release position to a second, engagement position and has a locating pin which, in the engagement position, engages a corresponding seat in the support unit when it is in the predetermined starting configuration.

8. A mixing device according to claim 7, wherein said locking unit also comprises an operating member carried by said arm, an auxiliary electric motor operatively connected to said operating member for engagement with operating means for clamping the container on the support unit and releasing it therefrom when the support unit is in the predetermined starting configuration.

9. A mixing device according to claim 1, wherein said device comprises sensor means for detecting the position of the locking unit.

10. A device for mixing liquid products:

a support unit for supporting at least one container for the liquid products;

driving means for driving said support unit with a motion for mixing the liquid products;

signaling means for providing at least one signal indicative of at least one quantifiable characteristic of said liquid products or of said at least one container;

microprocessor control means for activating said driving means in a sequence of operation selected from at least a first and a second different sequence of operation, in dependence on the at least one signal provided by the signaling means, said selected sequence of operation including at least one operating parameter wherein said microprocessor control means varies said at least one operating parameter on the basis of said at least one signal, wherein at least the first sequence of operation comprises at least two steps in which the speed of the support unit assumes a value which is in the range between zero and a predetermined maximum value and which is kept substantially constant in each step but differs from one step to another.

11. A mixing device according to claim 10, wherein the signaling means comprise sensor means for detecting said at least one quantifiable characteristic, selected from the group comprising:

the height of the container, the volume of the container, the weight of the container, the volume of the liquid products, the weight of the liquid products, the density of the liquid products, the viscosity of the liquid products, and the composition of the liquid products.

12. A mixing device according to claim 11, wherein the mixing device comprises clamping means for clamping said at least one container on the support unit and wherein said sensor means are associated with said clamping means in order to detect said at least one quantifiable characteristic of the container.

13. A mixing device according to claim 10, wherein said at least first and second sequences of operation differ, within a period of time not exceeding the duration of a complete mixing cycle, for at least one of the following parameters;

the period for which the driving means is activated, the speed of the motion imparted to the support unit, the acceleration imparted to the liquid products, the configuration of the motion of the support unit, and the amplitude of the motion of the support unit.

14. A mixing device according to claim 10, wherein at least one additional step in which the speed of the support unit can be varied continuously with a ramp-like progression is interposed between said at least two steps in which the speed is constant.

15. A mixing device according to claim 10, wherein the mixing device comprises locking means for selectively locking the support unit in a predetermined configuration.

16. A device for mixing liquid products:

a support unit for supporting at least one container for the liquid products;

driving means for driving said support unit with a motion for mixing the liquid products;

signaling means for providing at least one signal indicative of at least one quantifiable characteristic of said liquid products or of said at least one container;

microprocessor control means for activating said driving means in a sequence of operation selected from at least a first and a second different sequence of operation, in dependence on the at least one signal provided by the signaling means, said selected sequence of operation including at least one operating parameter wherein said microprocessor control means varies said at least one operating parameter on the basis of said at least one signal, wherein the mixing device comprises locking means for selectively locking the support unit in a predetermined configuration.

17. A mixing device according to claim 16, wherein the signaling means comprise sensor means for detecting said at least one quantifiable characteristic, selected from the group comprising:

the height of the container, the volume of the container, the weight of the container, the volume of the liquid products, the weight of the liquid products, the density of the liquid products, the viscosity of the liquid products, and the composition of the liquid products.

18. A mixing device according to claim 17, wherein the mixing device comprises clamping means for clamping said at least one container on the support unit and wherein said sensor means are associated with said clamping means in order to detect said at least one quantifiable characteristic of the container.

19. A mixing device according to claim 16, wherein said at least first and second sequences of operation differ, within a period of time not exceeding the duration of a complete mixing cycle, for at least one of the following parameters;

the period for which the driving means are activated, the speed of the motion imparted to the support unit, the acceleration imparted to the liquid products, the configuration of the motion of the support unit, and the amplitude of the motion of the support unit.

* * * * *